United States Patent [19]

Heimel

[11] 4,142,397

[45] Mar. 6, 1979

[54] COUNTERBLOWING MACHINE HAMMER

[75] Inventor: Othmar Heimel, Behamberg, Austria

[73] Assignee: "Wefoba" Werkzeug-und Formenbau Gesellschaft m.b.H. Co. KG, Steyr, Austria

[21] Appl. No.: 839,434

[22] Filed: Oct. 5, 1977

[30] Foreign Application Priority Data

Oct. 14, 1976 [AT] Austria ..... 7665/76

[51] Int. Cl.[2] ..... B21J 7/24; B21J 7/28

[52] U.S. Cl. ..... 72/407; 72/453.08; 72/453.18

[58] Field of Search ..... 72/407, 453.1, 453.18, 72/437, 441, 443, 453.8

[56] References Cited

U.S. PATENT DOCUMENTS

| | | | |
|---|---|---|---|
| 3,180,129 | 4/1965 | Riemenschneider | 72/453.1 |
| 3,339,397 | 9/1967 | Heimel | 72/407 |
| 3,429,174 | 2/1969 | Fracke | 72/453.18 |
| 3,707,866 | 1/1973 | Brauer | 72/407 |
| 3,847,008 | 11/1974 | Schmoll | 72/407 |

*Primary Examiner*—C.W. Lanham
*Assistant Examiner*—Gene P. Crosby
*Attorney, Agent, or Firm*—Fleit & Jacobson

[57] ABSTRACT

A counterblow machine hammer, which is pneumatically operated and in which the tups are hydraulically returned and at their rear end protrude into compressed air chambers, which are interconnected and by a pressure-regulating valve are constantly connected to a compressed air system. The impact energy of the tups is controlled by the air pressure in the air chambers.

6 Claims, 4 Drawing Figures

COUNTERBLOWING MACHINE HAMMER

SUMMARY OF THE INVENTION

Figures 1, 2, 3, 4:
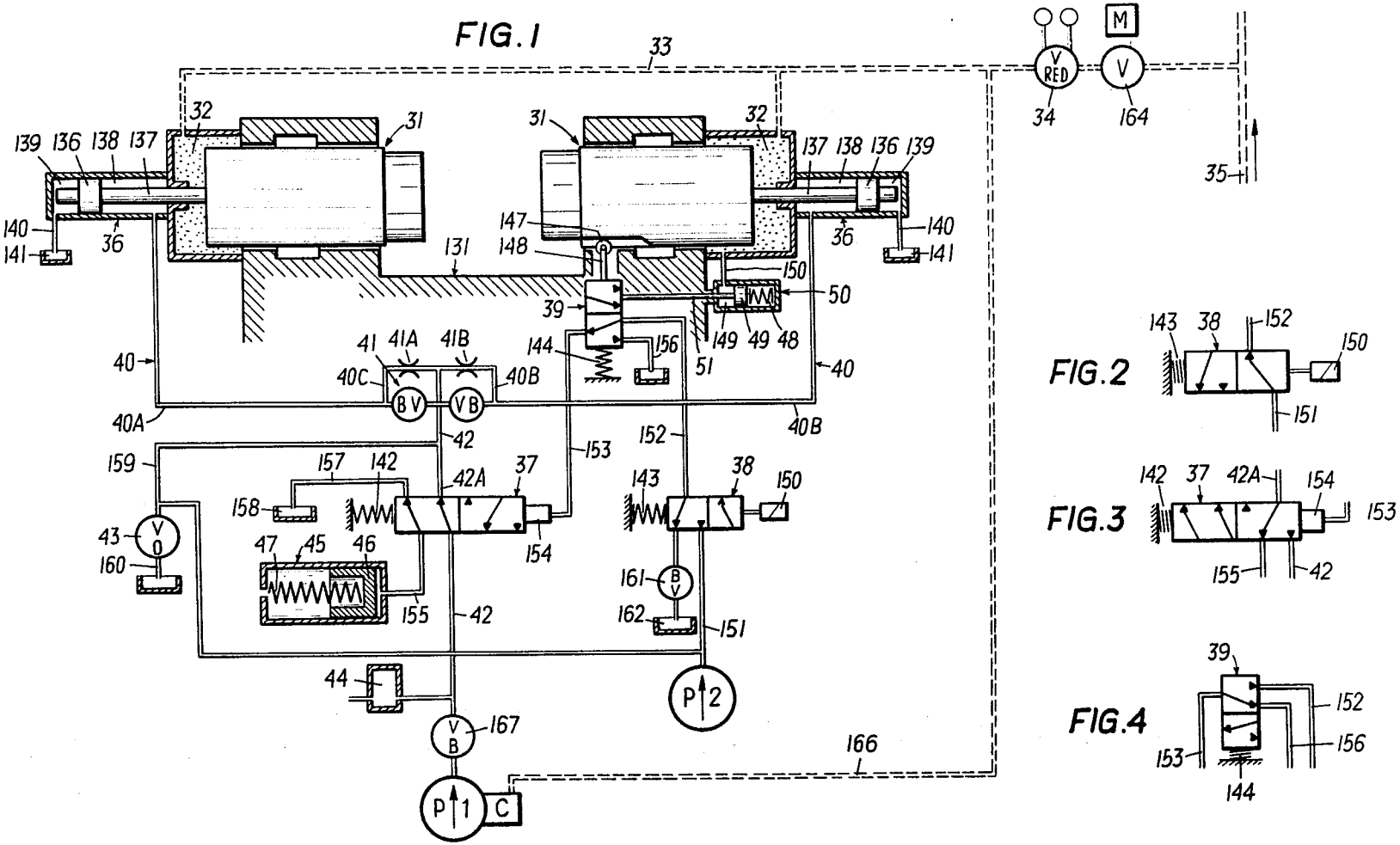

A counterblowing machine hammer which comprises two tups, which at their ends that are remote from each other protrude into compressed air chambers, which are connected to each other and adapted to be selectively connected to a compressed air source.

This invention relates to a counterblowing machine hammer which is pneumatically operated and in which the tups are hydraulically returned.

Vertical counterblowing machine hammers in which the two tups are coupled by steel tapes or by belts and which are operated with compressed air or steam have been known for a long time, also counterblowing hammer machines which are hydraulically operated and hydraulically synchronized. There are also horizontal counterblowing hammer machines, which are pneumatically operated and reset ("Impacter" of U.S. Industries) or which have positively synchronized, gas-hydraulic drive systems (Austrian Patent Specification 244,717).

The known machines mentioned above have the disadvantage that the tups continue to bear on each other after the blow before the return movement begins. This continued bearing results in a long time of contact between the tups and the blank, which has been heated to the forging heat, so that the tups are excessively heated. Besides, the tups may bounce during the time from the end of the blow and the beginning of the return movement and such bouncing may result in a repeated engagement of the dies. Difficulties have also been encountered as regards the positioning of the interface in the middle of the blank because the movement of each tup is initiated by a separate valve and a complicated and expensive system is required when it is desired to correct the initiating times in case of a deviation of the interface from the central position. A further disadvantage resides in the need for a large compressor plant.

Disadvantages of the machine described in the above-mentioned Austrian patent specification reside in the strong hydraulic pressure surges which occur in the conduits leading to the power cylinders when the tups blow on each other and which may result in pipe fracture, also in the highly expensive structure of the drive means, in the low energy efficiency and the continuous need for highly compressed nitrogen.

It is an object of the invention to provide a counterblowing machine hammer which is of the type mentioned first hereinbefore and in which these disadvantages are avoided.

An embodiment of such machine hammer will now be explained more fully with reference to the drawing, in which FIG. 1 is a highly simplified view of a machine hammer according to the invention and FIGS. 2 to 4 show several valves in different positions.

The machine differs from known designs in that compressed air from the compressed air system rather than high-pressure nitrogen is used for a storage of energy. There is no positive synchronization of tup movements, but the synchronization of the tup movements is due only to the fact that the two tups have the same mass and are subjected to equal pneumatic and hydraulic forces, which act on both tups at the same time. Different friction conditions may result in deviations but these can only be small, except in a case of chafing in the tracks.

Compared to machines which are positively synchronized by hydraulic means, the system according to the invention has also the advantage that different from the known machine hammers there are no very high pressure peaks in the compensating and operating conduits and cylinders at the time of the blow, particularly of a bouncing blow.

In the novel system, any air which is contained in the hydraulic system can have only rather harmless effects and a high expenditure for removing such air is not required.

Two horizontally extending, identical tups 31 are guided in a support 131. Pneumatically operated air chambers 32 are provided on the rear of the tups 31 and are interconnected by a pipeline 33, which is supplied with compressed air from a compressed air system 35 through a conduit 165, which incorporates a pressure-reducing valve 34 and a solenoid valve 164. The pressure-reducing valve is adjustable to control the pressure and consequently the impact energy. The compressed air is not consumed but serves as an energy storage fluid. The chambers are so large that the final pressure resulting from the expansion during the blow is about 70% of the initial pressure. Additional compressed air is fed from the compressed air system 35 under the control of the solenoid valve 164 when an increase of the pressure in the chambers 32 is desired.

Two hydraulic cylinders 36 are provided for returning the tups and holding the tups in their initial position against the pressure in the air chambers 32. Each cylinder 36 contains a piston 136 and a pistonrod 137, which is connected to the associated tup 31. Oil under pressure is supplied to the cylinders 36 from a pump P1 via control valve 37. The two cylinders are also interconnected by a conduit 40. The pump P1 supplies liquid through the check valve 167 and the valves shown on the drawing into the cylinder chamber 138 on that side of the piston 136 from which the piston rod extends. The other chambers 139 are connected by a conduit 140 to a compensating container 141. The working and return strokes are controlled by a control valve 37, which is controlled by the solenoid valve 38 or the mechanically actuated valve 39. Each of the three valves 37, 38, 39 is biased by a respective resetting spring 142, 143 or 144, which tends to move the associated valve to its initial position.

The conduit 40 which connects the two hydraulic cylinders 36 incorporates a throttle-check valve assembly 41, from which a conduit 42 extends. Said valve assembly comprises two check valves 41A and 41B, which are incorporated in respective branch conduits 40A and 40B leading to respective hydraulic cylinders 36. Each of the check valves 41A and 41B blocks the flow to the respective hydraulic cylinder 36. Conduit 42 opens into the conduit 40 between the two check valves 41A, 41B. A by-pass conduit 40C or 40D branches from each of the branch conduits 40A and 40B before its connection to the respective check valve 41A or 41B. Each of the by-pass conduits 40C and 40D opens into the conduit 42 and incorporates a throttle 41A or 41B, which thus by-passes the associated check valve 41A or 41B. Conduit 42 leads to the valve 37 and a pressure relief valve 43 and can be connected by the valve 37 to the pump P1, which is provided with a pressure accumulator, or to a compensating cylinder 45. The latter contains a piston 46, which is biased by a spring 47.

When the piston has been displaced against the spring 47 as far as possible, the compensating cylinder has the same cubic capacity as the working chambers of both hydraulic cylinders 36.

The stem valve 39 is actuated by a cam face 145, which is provided on one of the two tups 31 and engaged by a roller 147, which is rotatably mounted at the end of a stem 148. The exact time at which this valve is shifted to change the position of the valve 37, which is actuated by the valve 39, depends on the air pressure in the pressure chamber 32 and on the force exerted by a spring 48 on the piston 49, which is also subjected to the pressure in the pressure chamber 32. The piston 49 and the spring 48 are accomodated in a cylinder 50, which has a chamber 149 that is disposed in front of the piston 49 and connected by a conduit 150 to the chamber 32. The piston 49 is connected by a piston rod 51 to the valve 39.

Pressure fluid for actuating the valve 37 is supplied by the pump P2 and controlled by valves 38 and 39. That pressure fluid consists preferably of oil or a similar liquid under pressure.

When it is desired to initiate a blow of the forging machine, the solenoid 150 of the valve 38 is energized so that the valve 38 is shifted to the left against the force of the spring 143 and assumes the position shown in FIG. 2 to connect conduit 151 from pump P2 to conduit 152 leading to valve 39. At this time, the valve 39 is in its illustrated initial position to connect conduit 152 to conduit 153, through which oil under pressure from the pump P2 is supplied to the control piston 154 of the valve 37 to displace the control piston 154 to the position shown in FIG. 3 against the pressure exerted by the return spring 142. As a result, the branch conduit 42A from the throttle-check valve assembly 41 is connected to the conduit 155 leading to the compensating cylinder 45. The two cylinders 36 are connected to the spring-loaded storage cylinder 45, which is designed to take up exactly the quantity of oil which is displaced from the cylinders 36 during the blow. At the end of the blow, the damped piston 46 in the cylinder 45 brakes the oil which is displaced from the cylinders 36 at high velocity. As a result, a formation of a vacuum in the pipelines as a result of the sudden stoppage of the tups at the time of the forging blow is prevented.

Because the tups are identical in mass and subjected to the same pressure, their working strokes are synchronized. During said working stroke, the cam face 145 actuates the stem valve 39 before the working stroke is completed so that the valve 39 is moved against the pressure exerted by the spring 144 to the position shown in FIG. 4, in which conduit 153 is separated from conduit 152 and connected to a drain conduit 156. As a result of this valve actuation, the piston 154 for actuating the control valve 37 has been pressure-relieved so that the spring 142 moves the valve 37 back to the charging position, which is shown in FIG. 1 and in which the cylinder 45 is connected by conduit 157 to a pressure-relieved reservoir 158. The cylinders 36 are now again connected to the pump P1 and the tups are forced to their initial position against the pressure in the air chambers 32. The return speed is controlled by throttle-check valves 34. At the same time, the oil which has been displaced into the interim storage chamber 45 during the working stroke is forced through the control valve 37 into the tank 158 by the storage piston 46 under the influence of the spring so that the storage piston 46 is then ready for the next blow. In the meantime, the spring 143 has moved the valve 38 to its initial position to connect conduit 152 through a check valve 161 to a reservoir 162.

To prevent an excessive pressure rise in the cylinders 36 and in the conduits leading to the valve 37 in case of a premature reversal, the control block incorporates a directly acting pressure relief valve 43, which is biased by the continuously applied discharge pressure of the pump P2. That valve is incorporated in conduit 159, which is connected at one end to the branch conduit 42A and at the other end to the conduit 151. The compensating liquid is drained through conduit 160.

The advanced timing of the stem-actuated valve 39, corresponding to the stroke of the tup from the time at which that valve is actuated until the forging blow has been completed, is controlled by the piston 49 which moves in the air cylinder 50 against the pressure exerted by the spring 48. The air cylinder 50 communicates with the pressure chambers 32. Via conduits 33 and 166, the air chambers 32 communicate also with an air cylinder, which acts on a pressure compensator P of pump P1 and preferably is a component of said pump and for this reason is not shown. This ensures that the maximum discharge pressure of the pump is automatically adjusted to the instantaneous air pressure in the air chambers so that energy is saved in the operation of the machine. The impact energy can be infinitely adjusted by an adjustment of the air pressure in the chambers 32.

I claim:

1. A counterblow machine hammer comprising:

two hammer tups;

guide means for supporting said hammer tups in mutually opposing relationship in such manner that forward working ends of said hammer tups face each other and rear ends face away from each other, the rear ends being positioned in separate air chambers formed by first housings defined within said guide means, the rear ends of said hammer tups having portions protruding from said first housings;

second housing means adapted to define separate chambers for receiving said protruding portions of respective ones of said hammer tups, said protruding portions including pistons positioned in said second housing means;

pneumatic drive means acting on said rear ends of said hammer tups for pneumatically driving said hammer tups towards each other in a forward working movement direction, said pneumatic drive means including first conduit means for interconnecting said separate compressed air chambers, and second conduit means for connecting said first conduit means to a compressed air source; and hydraulic means acting on said pistons of said protruding portions for hydraulically moving said hammer tups away from each other.

2. A counterblow machine hammer as set forth in claim 1, wherein said second conduit means includes valve means for closing said second conduit means and for regulating pressure in said second conduit means.

3. A counterblow machine hammer as set forth in claim 2, characterized in that said hydraulic means further comprises a pump, a storage cylinder, and a sliding control valve movable between first and second positions for controlling the blow of said hammer tups, said control valve, in said first position, connecting said pump to said second housing means thereby moving said tups away from each other and said control valve, in said second position, connecting said second housing means to said storage cylinder, which is disposed in an oil reservoir, so that a forging blow is performed.

4. A counterblow machine hammer as set forth in claim 3, characterized in that a spring-biased piston is movable in the storage cylinder and has a displacement which is exactly equal to the displacement of the pistons in said chambers of said second housing means, and that the storage cylinder receives, during the forward movement of the hammer tups, the oil which is displaced from said chambers of said second housing means and delivers said oil to the oil reservoir when the sliding control valve has been subsequently shifted to said first position.

5. A counterblow machine hammer as set forth in claim 3, characterized in that a stem valve is actuated by one of the hammer tups shortly before the two hammer tups complete their forward movement during the working stroke and the sliding control valve for controlling the blow is shifted to said first position in response to the actuation of said stem valve.

6. A counterblow machine hammer as set forth in claim 3, characterized in that the movement of the hammer tups away from each other is controlled by two mutually independently acting throttle-check valve assemblies and the pump discharge pressure for moving the hammer tups away from each other is controlled by a control cylinder, which communicates with the compressed air chambers and acts on a pressure compensator of the pump.

* * * * *